United States Patent [19]

Offermann

[11] 3,955,770

[45] May 11, 1976

[54] COIL SUPPORT FOR STRIP UNCOILER

[75] Inventor: Joseph V. Offermann, Hamilton Township, Mercer County, N.J.

[73] Assignee: United States Steel Corporation, Pittsburgh, Pa.

[22] Filed: Nov. 2, 1973

[21] Appl. No.: 412,076

[52] U.S. Cl. ..... 242/68.4; 242/78.6

[51] Int. Cl.[2] ..... B65H 19/02

[58] Field of Search ..... 242/78.6, 68.4, 68.1, 242/68.2, 68.5, 68.6, 129.51, 55.2

[56] References Cited

UNITED STATES PATENTS

| | | | |
|---|---|---|---|
| 2,113,701 | 4/1938 | Mayer | 242/68.2 |
| 2,332,576 | 10/1943 | Iversen et al. | 242/78.6 |
| 2,800,288 | 7/1957 | Bandy | 242/68.4 X |
| 2,838,249 | 6/1958 | Riemenschneider | 242/55.2 |
| 2,884,299 | 2/1959 | Sandrock | 242/68.4 UX |
| 3,295,784 | 1/1967 | Wahl | 242/68.3 |

*Primary Examiner*—Stanley N. Gilreath
*Assistant Examiner*—John M. Jillions
*Attorney, Agent, or Firm*—Rea C. Helm

[57] ABSTRACT

The coil support of the invention comprises conical shaped mandrels disposed on the end of the horizontal rotatable shaft in each of the two coil supporting assemblies of a strip uncoiler. The surface of the mandrels of the invention each have indentations spaced around its circumference. Such indentations are preferably in the form of axially directed with the surface area of the lands substantially larger than the surface area removed by the grooves.

2 Claims, 4 Drawing Figures

COIL SUPPORT FOR STRIP UNCOILER

The present invention relates to handling coils of strip steel or other material and more particularly to the coil support elements of a strip uncoiler.

As it is well known in the art, an apparatus termed a strip uncoiler is used to unwind coils of metal strip at the entry end of a strip processing line so the strip can be fed continously into the line. Two types of such apparatus are disclosed by U.S. Pat. No. 2,800,288 dated July 23, 1957 and U.S. Pat. No. 2,837,295 dated June 3, 1958.

As disclosed by the aforementioned patents, the conventional uncoiler consists of two assemblies, each of which includes a conical shaped mandrel supported on a shaft connected to a drive means or a brake means. Each assembly is mounted on a carriage movable in and out of an extension of the pass line of the processing equipment by a means of rack-and-pinion, pressure cylinders, or other suitable means. In operation, the carriages are moved away from each other to retract the mandrels and allow a coil of strip material to be centered in the uncoiler. After the coil has been so centered, movement of the carriages toward each other is effected so as to insert the mandrels into opposite ends of the eye of the coil. Then the metal strip can be fed into the entry end of the processing line by actuating the driving means of the uncoiler after which the brake means are used to exert a restraining force against rotation of the coil to apply tension to the strip and prevent uncontrolled unwinding when the strip is pulled through the processing line.

Prior to my invention the circumferential areas of the mandrels were provided with projecting ribs which were welded on the circumferential surface of each mandrel. The gripping effect of the ribs prevented the coil from slipping or skidding on the mandrel surface. These weld ribs, protruding approximately ⅜ inch to ½ inch from the circumferential surface of the mandrel, would however tend to cause damaging surface deformation in the eye of the coil at the points where the ribs contacted the inner wrap of the coil within the eye thereof. Such deformation would progress through a substantially number of wraps of the coil from the eye thereof. The magnitude of deformation would vary proportional to the thickness of the strip or other material being processed. Such deformation would be more intensive in the case of light, thin gage strip and less intensive with heavy, thicker gage strip.

This rendered a considerable number of wraps of strip surrounding the coil eye scrap which could not be used as prime product. Frequently, breaks would also occur in the coil strip because of coil eye slippage experienced when the weld ribs became worn.

Accordingly, it is the primary object of my invention to provide an improved coil support for a strip uncoiler comprising a pair of mandrels each having a conical shaped surface formed with indentations spaced therearound.

It is a more specific object of my invention to provide mandrels of the character set forth by the above-stated object wherein the indentation are in the form of axially directed grooves with the area of the lands substantially larger than the conical shaped surface area removed by the grooves.

It is another object of my invention to provide mandrels of the character set forth above in which the cone conical surface is on a sleeve which is adapted to be removably mounted on the end of the uncoiler shaft.

These and other objects will become more apparent after referring to the following specification and attached drawing, in which.

Figure 1:
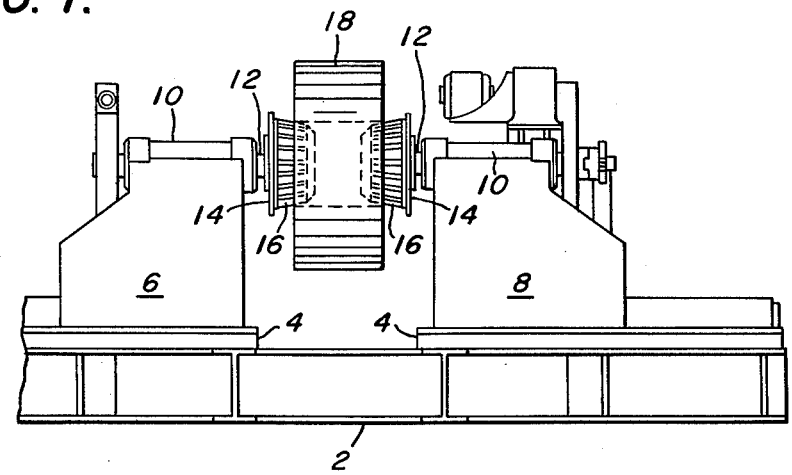
FIG. 1 is an elevational view of a strip uncoiler wherein the supporting mandrels of my invention have been incorporated.
Figure 2:
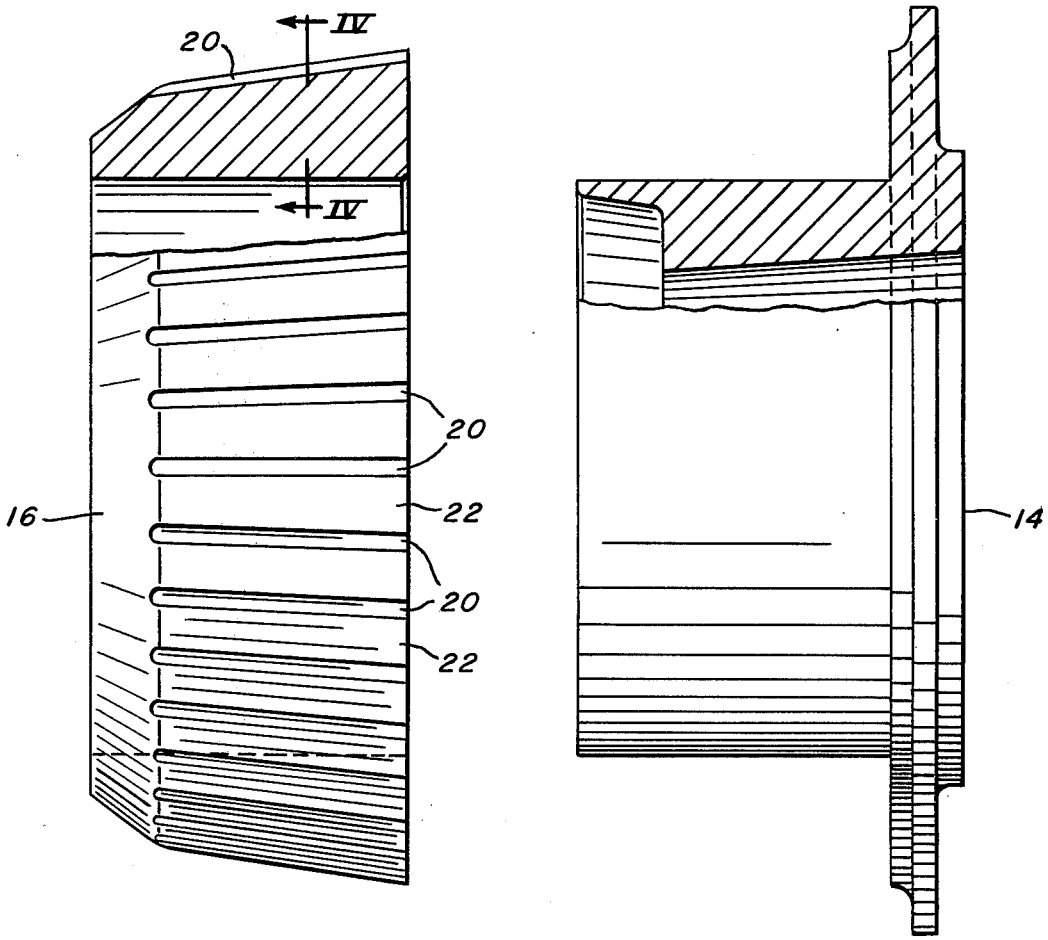
FIG. 2 is an exploded view of one of the mandrels of my invention and the shaft on which it is mountable.
Figure 3:
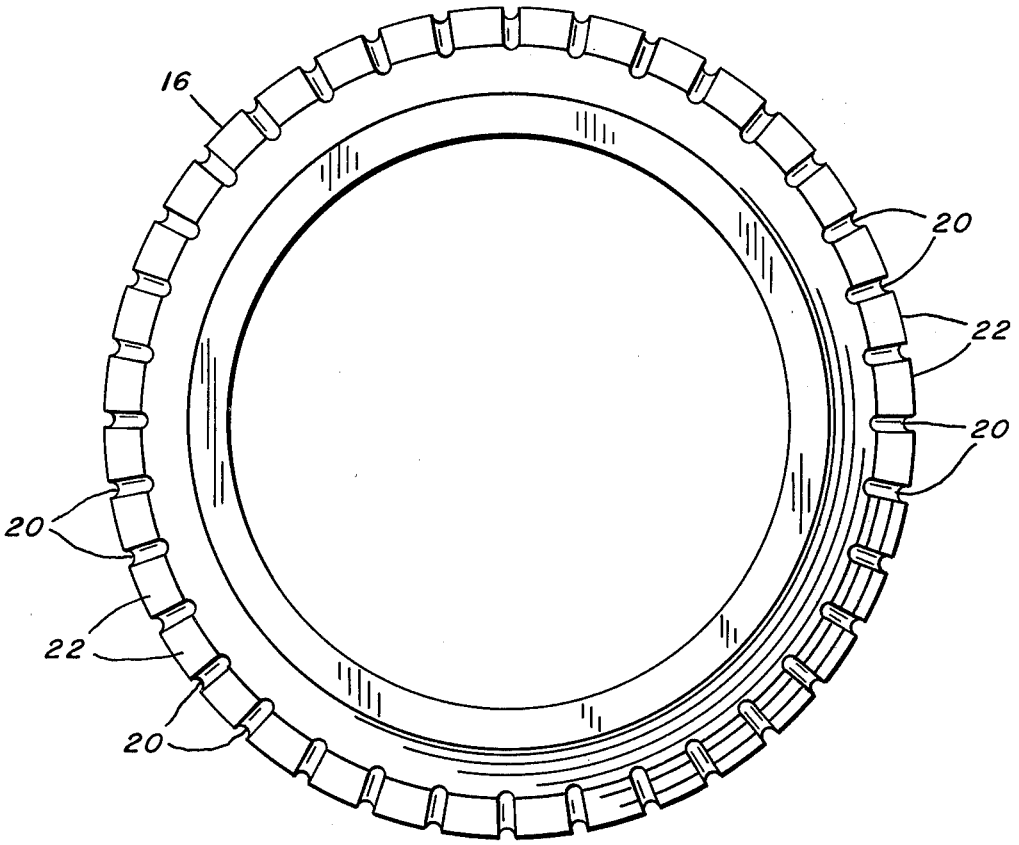
FIG. 3 is a front elevational view of a mandrel of the invention.

Referring more particularly to the drawing, reference numeral 2 designates the base of an uncoiler apparatus which is formed of suitable structural members and which supports aligned pairs of tracks or ways 4. Mounted on the tracks 4 for sliding movement toward and away from each other are coil-supporting assemblies 6 and 8.

Both coil-supporting assemblies 6 and 8 are provided with horizontally disposed journals 10 mounting rotatable shafts 12.

The apparatus thus far described is conventional and is not claimed as part of my invention, the details of which will now be described.

The facing ends of the shafts 12 are of reduced diameter and fit rigidly into hub portions 14 which are adapted to receive the conical shaped sleeve 16 of my invention thereon. The sleeves 16 are shrunk fit or otherwise rigidly affixed on the hub portions 14. The sleeves 16 are nitride hardened for durability. The sleeves 16 are adapted to be inserted into the eye of a coil 18 of sheet or strip material to rotatably support the coil in aligned relation with the entry end of a material processing line (not shown).

It will be understood that although I have shown the mandrel of my invention in the form of a sleeve adapted to fit on a hub shape end of a shaft, it could also be in the form of a conical shaped body, one affixed to each of the facing ends of the mandrel shafts of an uncoiler.

Figure 4:
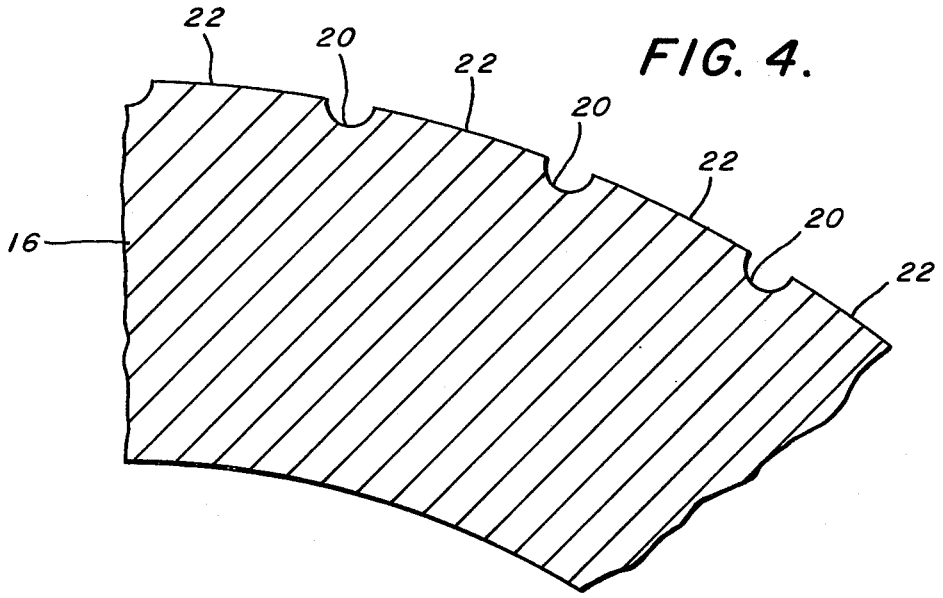
FIG. 4 is an enlarged cross-sectional view of a portion of a mandrel of the invention taken substantially along the line IV—IV of FIG. 2.

The circumferential surface of the sleeve 16 of the invention is provide with a plurality of axially directed grooves spaced around its circumference. The lands 22 of the circumferential surface of the of sleeve 16 are all part of a single conical surface, as best shown in FIG. 4. Grooves, ⅜ inch wide × ¼ inch deep spaced every 1½ inch around the periphery of the sleeve, were found to provide optimum performance. The grooves could be of other dimensions and still provide the necessary gripping effect when supporting a coil depending on the thickness of the coiled strip and the size of the coil.

It may be pointed out that other forms of indentation (not shown) in the circumferential surface of the cones could be used to obtain the gripping effect which results from the use of the axially directed grooves. Such other indentation could be in the form of circular craters, circumferentially directed grooves, etc. The essential feature is that the major portions of the circumferential surfaces of the sleeves are inverted rather than protruded to effect the positive holding of a supported coil on the surface of the sleeves and prevent slipping of the sleeves with respect to the coil when the shafts 12 are rotated. It has been found that this type of surface, formed with indentation rather than projections, is less likely to exert pressures on the inner coil eye wraps and create damage thereof so that a minimum or no damage to the strip surface occurs. This type of surface on the sleeves also prevents or reduces coil breaks which may occur while a coil is being processed.

The nitride hardening of the sleeve causes the cone sleeve to chip at the edges of the grooves 20 or other indentations and such chipping tends to increase the sleeve's gripping effect and hold the coil tighter to the surfaces of the sleeves. The replaceable sleeve form of mandrel is considerably cheaper than a complete mandrel body in that it eliminates extensive renovation of worn mandrel bodies. Such renovation ordinarily involves machining, re-welding, stress relieving and grinding. Use of the sleeve form of mandrel also minimizes production delays which would be necessitated by conventional renovation of a complete mandrel body.

While I have shown but one embodiment of my invention, other adaptations and modifications may be made without departing from the scope of the following claims.

I claim:

1. In an uncoiler for deformable material having a base, a pair of independently movable coil supporting assemblies on said base, means for moving said assemblies and a horizontally disposed rotatable shaft mounted on each coil supporting assembly; an improved coil support for minimizing damage to the inner wraps of the coil material comprising a mandrel attached to the end of each shaft, a hub portion mounted on each mandrel, a removable sleeve mounted on each hub portion, each of said sleeves having a conical shaped surface for engaging the material of the eye of the coil, said surfaces each having a plurality of circumferentially spaced apart axially directed grooves and a plurality of lands, the area of the lands being substantially larger than the conical surface area removed by the grooves and with said sleeves being nitride hardened thereby permitting groove edge chipping to increase coil gripping effect.

2. A coil support according to claim 1 in which the area of the lands is about three times the conical surface area removed by the grooves.

* * * * *